US011452649B2

(12) United States Patent
Bergman

(10) Patent No.: US 11,452,649 B2
(45) Date of Patent: Sep. 27, 2022

(54) LEG REST RELEASE MECHANISM AND WHEELCHAIR COMPRISING THE SAME

(71) Applicant: Permobil AB, Timrå (SE)

(72) Inventor: Hakan Bergman, Timrå (SE)

(73) Assignee: PERMOBIL AB, Timra (SE)

( * ) Notice: Subject to any disclaimer, the term of this patent is extended or adjusted under 35 U.S.C. 154(b) by 216 days.

(21) Appl. No.: 16/769,605

(22) PCT Filed: Dec. 14, 2018

(86) PCT No.: PCT/EP2018/084877
§ 371 (c)(1),
(2) Date: Jun. 4, 2020

(87) PCT Pub. No.: WO2019/121364
PCT Pub. Date: Jun. 27, 2019

(65) Prior Publication Data

US 2020/0315884 A1 Oct. 8, 2020

(30) Foreign Application Priority Data

Dec. 19, 2017 (EP) ..... 17208338

(51) Int. Cl.
*A61G 5/12* (2006.01)

(52) U.S. Cl.
CPC ..... *A61G 5/128* (2016.11)

(58) Field of Classification Search
CPC ..... A61G 5/128
(Continued)

(56) References Cited

U.S. PATENT DOCUMENTS 2,520,309 A * 8/1950 Everest ..... A61G 5/128 297/375
2,991,831 A * 7/1961 Jennings ..... A61G 5/12 254/106

(Continued)

FOREIGN PATENT DOCUMENTS

CN 1876475 12/2006
CN 102160836 8/2011

(Continued)

OTHER PUBLICATIONS

EP-0827729-A2 English Translation of Description Retrieved from Espacenet (Year: 2022).*

(Continued)

*Primary Examiner* — Jacob D Knutson
*Assistant Examiner* — Myles A Harris
(74) *Attorney, Agent, or Firm* — McAndrews, Held & Malloy, Ltd.

(57) ABSTRACT

The present disclosure relates to a leg rest release mechanism (1) for a wheelchair, wherein the leg rest release mechanism (1) comprises: a base member (3) having a base portion (3*a*) and an elongated axle portion (3*b*) extending from the base portion (3*a*), a leg rest swivel frame (5) in swivel connection with the axle portion (3*b*) to enable swivelling of the leg rest swivel frame (5) relative to the axle portion (3*b*), wherein the leg rest swivel frame (5) is configured to be connected to an elongated foot rest mounting member (9) provided with a foot rest (5), and a release member (7) having a lifting handle (7*a*), wherein the release member (7) extends through the leg rest swivel frame (5) and wherein the release member (7) is biased to engage with the base portion (3*a*) to thereby lock the leg rest swivel frame (5) in a fixed position relative to the base member (3), wherein the release member (7) is configured to disengage from the base portion (3*a*) by pulling of the lifting handle (Continued)

(7*a*), whereby the leg rest swivel frame (5) is enabled to swivel relative to the base member (3).

17 Claims, 3 Drawing Sheets

(58) Field of Classification Search
USPC ..... 280/304.1
See application file for complete search history.

(56) References Cited

U.S. PATENT DOCUMENTS

| | | | | | |
|---|---|---|---|---|---|
| 3,189,385 | A * | 6/1965 | Mommsen | A61G 5/127 | 297/423.26 |
| 3,376,067 | A * | 4/1968 | Kernes | A61G 5/1054 | 297/423.24 |
| 3,453,027 | A * | 7/1969 | Pivacek | A61G 5/128 | 297/423.37 |
| 3,790,212 | A * | 2/1974 | Suyetani | A61G 5/128 | 297/423.26 |
| 3,854,774 | A * | 12/1974 | Limpach | A61G 5/125 | 297/423.37 |
| 3,857,606 | A * | 12/1974 | Rodaway | A61G 5/12 | 297/423.37 |
| 4,033,624 | A * | 7/1977 | Jun | A61G 5/125 | 297/423.3 |
| 4,722,572 | A * | 2/1988 | Sata | A61G 5/12 | 297/423.37 |
| 4,988,114 | A * | 1/1991 | Thornton, Jr. | A61G 5/1054 | 297/423.37 |
| 5,020,817 | A * | 6/1991 | Leib | A61G 5/128 | 297/286 |
| 5,201,087 | A * | 4/1993 | Wickham | A61G 5/00 | 5/613 |
| 6,543,854 | B1 * | 4/2003 | Finch | A61G 5/12 | 297/423.37 |
| 6,880,845 | B1 * | 4/2005 | Broyles | A61G 5/12 | 297/423.36 |
| 2002/0153697 | A1 * | 10/2002 | Amirola | A61G 5/128 | 280/304.1 |
| 2003/0030251 | A1 * | 2/2003 | Malassigne | A61G 5/0891 | 280/648 |
| 2006/0012148 | A1 * | 1/2006 | Melgarejo | A61G 5/128 | 280/304.1 |
| 2007/0194554 | A1 * | 8/2007 | Slagerman | A61G 5/1054 | 280/304.1 |
| 2008/0001461 | A1 * | 1/2008 | Fujihara | A61G 5/12 | 297/423.35 |
| 2010/0007180 | A1 | 1/2010 | Ovre et al. | | |
| 2010/0186163 | A1 | 7/2010 | Sorribes et al. | | |
| 2011/0272200 | A1 | 11/2011 | Clapp et al. | | |
| 2018/0185217 | A1 * | 7/2018 | Chen | A61G 5/128 | |
| 2019/0201259 | A1 * | 7/2019 | Hanley | A61G 5/1051 | |

FOREIGN PATENT DOCUMENTS

| | | | | | |
|---|---|---|---|---|---|
| CN | 102885678 | | 1/2013 | | |
| CN | 103027797 | | 4/2013 | | |
| CN | 203539570 | | 4/2014 | | |
| CN | 203709620 | | 7/2014 | | |
| CN | 204233321 | | 4/2015 | | |
| CN | 204600939 | | 9/2015 | | |
| CN | 105101929 | | 11/2015 | | |
| CN | 205031445 | | 2/2016 | | |
| CN | 105640722 | | 6/2016 | | |
| CN | 110478148 | A * | 11/2019 | | |
| DE | 2754978 | A1 * | 6/1979 | | |
| DE | 3740336 | A1 * | 6/1989 | | |
| DE | 29722373 | U1 * | 4/1998 | A61G 5/08 | |
| DE | 20006172 | | 9/2000 | | |
| DE | 10243309 | A1 * | 4/2004 | A61G 5/00 | |
| DE | 202005015563 | | 12/2005 | | |
| DE | 102005014637 | B3 * | 6/2006 | A61G 5/12 | |
| EP | 0827729 | A2 * | 3/1998 | | |
| EP | 1627619 | A2 * | 2/2006 | A61G 5/02 | |
| FR | 2157636 | A5 * | 6/1973 | | |
| GB | 925699 | A * | 5/1963 | | |
| GB | 1185160 | A * | 3/1970 | | |
| GB | 1250904 | | 10/1971 | | |
| GB | 1258251 | | 12/1971 | | |
| GB | 1565986 | A * | 4/1980 | A61G 5/12 | |
| JP | S6297550 | | 5/1987 | | |
| KR | 200406017 | Y1 * | 1/2006 | | |
| KR | 20070034758 | A * | 3/2007 | | |
| KR | 20080003203 | A * | 1/2008 | | |
| KR | 101316246 | | 10/2013 | | |
| TW | 403646 | | 9/2000 | | |
| TW | 462889 | | 11/2001 | | |
| TW | M533981 | U | 12/2016 | | |

OTHER PUBLICATIONS

Office Action for Chinese Application No. 201880077355.7 dated Oct. 18, 2021, 15 pages.
Communication Pursuant to Article 94(3) EPC from the European Patent Office for Application No. 17208338.8 dated Jan. 23, 2020, 5 pages.
Extended European Search Report for Application No. 17208338.8 dated Jun. 1, 2018, 6 pages.
International Search Report and Written Opinion corresponding to International Patent Application No. PCT/EP2018/084877, dated Feb. 20, 2019.
Office Action and Search Report for Taiwan Application No. 107143885 dated Apr. 11, 2022, 8 pages.

* cited by examiner

LEG REST RELEASE MECHANISM AND WHEELCHAIR COMPRISING THE SAME

CROSS-REFERENCE TO RELATED APPLICATIONS/INCORPORATION BY REFERENCE

The present application is the U.S. national phase under § 371 of International Application No. PCT/EP2018/084877, having an international filing date of Dec. 14, 2018, which claims priority to EP Patent Application No. 17208338.8, filed Dec. 19, 2017. Each of the above-mentioned prior-filed applications is hereby expressly incorporated herein by reference in its entirety.

TECHNICAL FIELD

The present disclosure generally relates to a leg rest for a wheelchair.

BACKGROUND

Wheelchairs are typically equipped with leg rests on which a user may rest their legs.

The position of the leg rest may be adjusted by the user in order to simplify for the user to take a seat in the wheelchair or to move away from the wheelchair. This action typically involves moving the leg rests to the side of the seat to facilitate for the user to move into our out from the seat.

Additionally, users may adjust the position of the leg rests when the wheelchair is to be stowed away to reduce its footprint, for example during transport of the wheelchair or at home. The leg rests may also be completely removed to reduce the footprint of the wheelchair.

The ability for a user to manoeuvre the leg rests generally depends on the capability of the user. Certain users may have disabilities which makes operations such as the manoeuvring of existing leg rests very difficult or essentially impossible.

SUMMARY

An object of the present disclosure is to provide a leg rest release mechanism which solves, or at least mitigates problems of the prior art.

There is hence according to a first aspect of the present disclosure provided a leg rest release mechanism for a wheelchair, wherein the leg rest release mechanism comprises: a base member having a base portion and an elongated axle portion extending from the base portion, a leg rest swivel frame in swivel connection with the axle portion to enable swivelling of the leg rest swivel frame relative to the axle portion, and a release member having a lifting handle, wherein the release member extends through the leg rest swivel frame and wherein the release member is biased to engage with the base portion to thereby lock the leg rest swivel frame in a fixed position relative to the base member, wherein the release member is configured to disengage from the base portion by pulling of the lifting handle, whereby the leg rest swivel frame is enabled to swivel relative to the base member.

Users with the capability to grab a lifting handle and pull it will thereby be able to release and manoeuvre the leg rest swivel frame in a simplified to manner. In particular, pulling of the leg rest swivel frame for its release and rotation of the leg rest swivel frame to adjust the desired position of the leg rest swivel frame may be obtained in a much simpler motion, allowing a user to rotate or even remove the leg rest swivel frame while still holding the pulled out release member.

According to one embodiment the release member is rotatable relative to the base portion and the leg rest swivel frame, and wherein the release member includes a rotation handle fixed relative to the lifting handle for rotating the release member, wherein rotation of the release member from a default position in which the release member engages with the base portion causes the release member to be axially displaced relative to the base portion, thereby disengaging from the base portion.

The motion to carry out the manoeuvring of the release member by means of the rotation handle is more complex than by using the lifting handle since it entails a rotation of the release member and of the leg rest swivel frame, potentially in different directions. However, this configuration would allow users without the capability to grab and pull a lifting handle to at least release the leg rest swivel frame from the base portion. The releasing of the leg rest swivel frame may be obtained by pushing the rotation handle, which generally results in that the rotation handle will rotate, causing the release member to disengage from the base member.

According to one embodiment the release member and the leg rest swivel frame are structured so that rotation of the release member from the default position causes the axial displacement.

According to one embodiment the rotation handle is at a right angle with the lifting handle.

According to one embodiment the leg rest swivel frame has a base adjacent portion through which the release member extends, and a hand rest portion spaced apart from the base adjacent portion and aligned with the lifting handle, wherein the lifting handle is configured to be pulled towards the hand rest portion to disengage the release member from the base portion.

According to one embodiment the base portion includes an opening and the release member has an elongate structure fixed to the lifting handle, which elongate structure is configured to extend through the leg rest swivel frame, wherein the elongate structure is biased towards and configured to be received by the opening to provide the engagement between the base portion and the release member.

According to one embodiment the elongate structure is a pin.

According to one embodiment the leg rest swivel frame has a latch configured to restrict axial displacement of the leg rest swivel frame relative to the base member only for a range of swivel angles of the leg rest swivel frame relative to the axle portion.

According to one embodiment the latch extends axially, with respect to an axis defined by the axle portion, beyond the base portion, the base portion being arranged between the latch and a main body of the leg rest swivel frame only for the range of swivel angles.

According to one embodiment the release member has a blocking portion configured to prevent the release member from being fully pulled out from the leg rest swivel frame.

One embodiment comprises a resilient member, wherein the release member is biased by the resilient member.

There is according to a second aspect of the present disclosure provided a leg rest assembly comprising a leg rest release mechanism according to the first aspect, a foot rest mounting member connected to the leg rest swivel frame, and a foot rest mounted to the foot rest mounting member.

There is according to a third aspect of the present disclosure provided a wheelchair comprising: a leg rest release mechanism according to the first aspect.

The wheelchair may be a manual wheelchair or a powered wheelchair.

One embodiment comprises a seat frame, wherein the axle portion is attached to a front edge of the seat frame.

One embodiment comprises an elongated foot rest mounting member connected to the leg rest swivel frame, and a foot rest mounted to the foot rest mounting member.

According to one embodiment the foot rest mounting member is pivotally connected to the leg rest swivel frame to enable changing of the position of the foot rest.

Generally, all terms used in the claims are to be interpreted according to their ordinary meaning in the technical field, unless explicitly defined otherwise herein. All references to "a/an/the element, apparatus, component, means, etc." are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
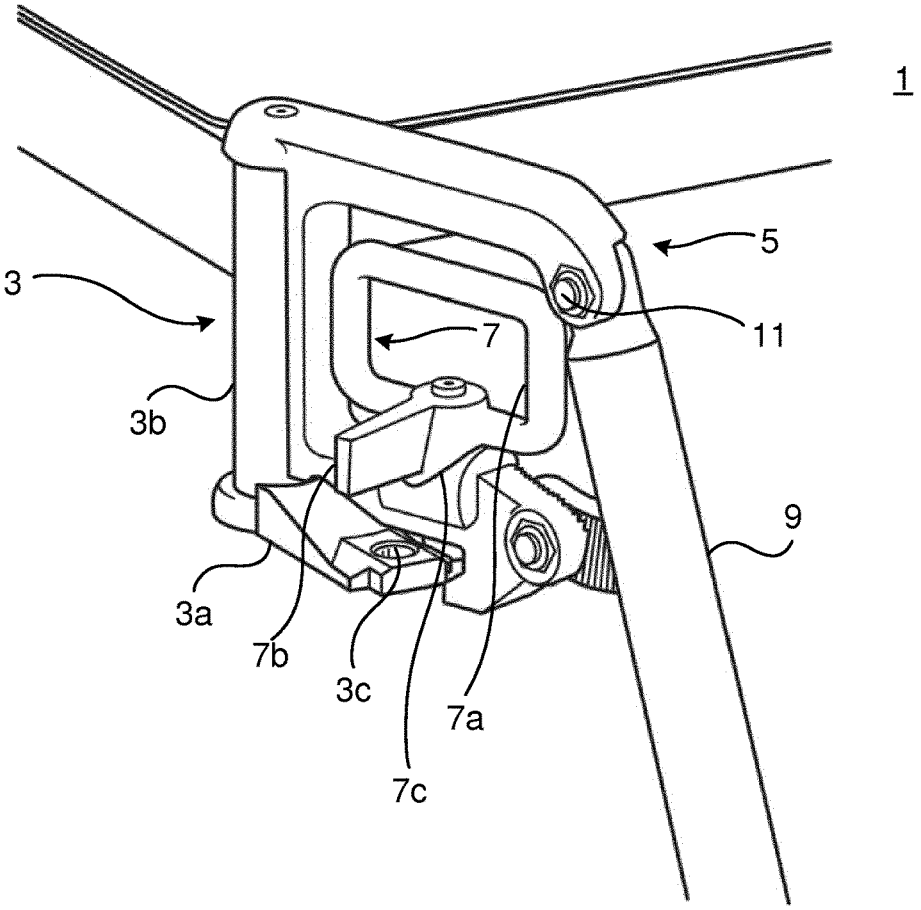
FIG. 1 schematically depicts a perspective view of a leg rest release mechanism for a wheelchair.

FIG. 1 shows an example of a leg rest release mechanism 1 for a wheelchair. The leg rest release mechanism 1 is configured to be mounted to a wheelchair. In particular, the leg rest release mechanism 1 may be configured to be mounted to a seat frame of a wheelchair.

The leg rest release mechanism 1 comprises a base member 3, a leg rest swivel frame 5, and a release member 7.

The base member 3 has a base portion 3*a* and an elongated axle portion 3*b*. The elongated axle portion 3*b* extends from the base portion 3*a*. The elongated axle portion 3*b* is at an angle, typically at a right angle, relative to the base portion 3*a*.

The leg rest swivel frame 5 is in swivel connection with the axle portion 3*b*. The leg rest swivel frame 5 is thereby able to swivel relative to the axle portion 3*b* and relative to the base portion 3*a*.

The release member 7 extends through the leg rest swivel frame 5. Thus, a portion of the release member 7 is received by the leg rest swivel frame 5. The release member 7 is configured to engage with the base portion 3*a* when aligned with the leg rest swivel frame 5. In particular, the release member 7 is biased to engage with the base portion 3*a*. The release member 7 has a lifting handle 7*a* extending from the leg rest swivel frame 5. The release member 7 may be manoeuvred by pulling the lifting handle 7*a* in a direction away from the base portion 3*a*. In this manner, the release member 7 may be disengaged from the base portion 3*a*. By disengaging the release member 7 from the base portion 3*a*, the leg rest swivel frame 5 is allowed to swivel relative to the base portion 3*a* and the axle portion 3*b*. FIG. 1 shows the leg rest release mechanism 1 with the leg rest swivel frame 5 disengaged from the base portion 3*a*. The base portion 3*a* furthermore comprises an opening 3*c*, which will be further elaborated upon with reference to FIG. 2.

The exemplified release member 7 also comprises an elongated rotation handle 7*b* which is fixed relative to the lifting handle 7*a*. The rotation handle 7*b* is fixed relative to the lifting handle 7*a*. The rotation handle 7*b* may be arranged at a right angle relative to the lifting handle 7*a*. In particular, the lifting handle 7*a* may define a plane and the rotation handle 7*b* may have a longitudinal extension which is perpendicular to this plane. The rotation handle 7*b* preferably extends laterally outwards when the leg rest release mechanism 1 is mounted to a wheelchair, facilitating for a user to manoeuvre the release mechanism 7 when seated in the wheelchair.

The release member 7 is configured to rotate relative to the base portion 3*a* and relative to the leg rest swivel frame 5. The release member 7 is configured to disengage from the base portion 3*a* when the release member 7 is rotated from a default position in which the release member 7 engages with the base portion 3, preferably by using the rotation handle 7*b*. The release member 7 is configured to be displaced axially relative to the base portion 3*a* when the release member 7 is rotated relative to the leg rest swivel frame 5 from the default position. In particular, the release member 7 is configured to perform the same motion of axial displacement when being rotated as when the lifting handle 7*a* is being pulled. This causes the disengagement of the release member 7 from the base portion 3*a*. The release member 7 may hence be axially displaced and disengaged from the base portion 3*a* in two different manners. In particular, the disengagement may be performed by pulling the release member 7 away from the base portion 3*a* using the lifting handle 7*a* or by rotating the release member 7 relative to the leg rest swivel frame 5 using the rotation handle 7*b*.

The leg rest swivel frame 5 and the release member 7 may be structured to enable axial displacement of the release member 7 relative to the leg rest swivel frame 5 and relative to the base portion 3*a* when the release member 7 is rotated. For example, as shown in FIG. 1, the release member 7 may be provided with an inclined portion 7*c* which encloses a portion of the external surface of the leg rest swivel frame 5 in the region of the rotation handle 7*b*. When the release member 7 is rotated relative to the leg rest swivel frame 5, the inclined portion 7*c* follows the external surface of the leg rest swivel frame 5, forcing the release member 7 to move axially relative to the leg rest swivel frame 5 and thus also relative to the base portion 3*a* in a direction away from the base portion 3*a*.

The leg rest swivel frame 5 may be configured to be connected to an elongated foot rest mounting member 9 provided with a foot rest (not shown). The foot rest mounting member 9 may be pivotally connected to the leg rest swivel frame 5 by means of a pivot connection ii. The position of the foot rest mounting member 9 and thus of the foot rest may thereby be changed/adjusted.

By disengaging or releasing the release member 7 from the base portion 3*a*, the foot rest mounting member 9 and the foot rest are able to swivel relative to the axle portion 3*b* of the base member 3. The position of a leg rest assembly, formed by the leg rest release mechanism 1, the foot rest mounting member 9 and the foot rest, can thus be swivelled or adjusted relative to the wheelchair to which it is mounted. This allows a user to swing the leg rest assembly laterally outwards to facilitate taking a seat and moving out from the wheelchair, and to swing the leg rest assembly inwards when the wheelchair is to be stowed away.

Figure 2:
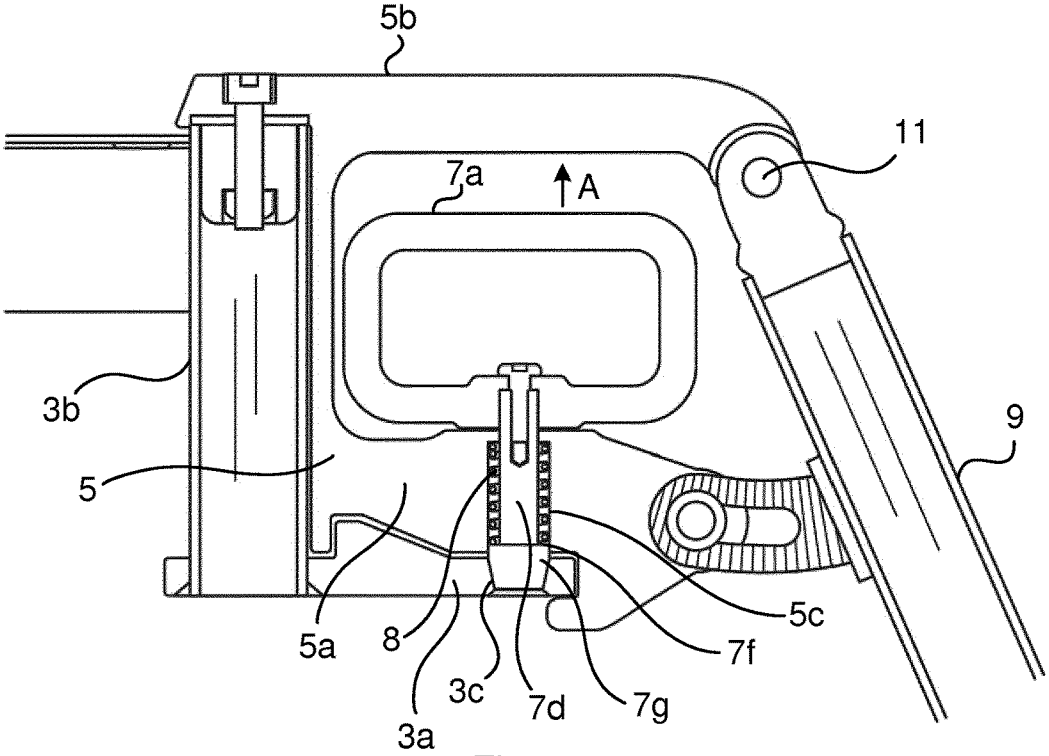
FIG. 2 depicts a side view of a partial section of the leg rest release mechanism in FIG. 1.

FIG. 2 shows a partial section of the leg rest release mechanism 1 when the release member 7 engages with the base portion 3*a* thereby locking the leg rest swivel frame 5 in a default fixed swivel position. The leg rest swivel frame 5 has a base adjacent portion 5*a* and a hand rest portion 5*b* spaced apart from the base adjacent portion 5*a*. The hand rest portion 5*b* is aligned with the lifting handle 7*a*. The hand rest portion 5*b* is in swivel connection with the axle portion 3*b*.

The base adjacent portion 5*a* is arranged aligned with and adjacent to the base portion 3*a* when the leg rest swivel frame 5 is in the default fixed swivel position. The base adjacent portion 5*a* is provided with a through-opening 5*c*. The base portion 3*a* has an opening 3*c* which is aligned with the through-opening 3*c* when the release member 7 is engaged with die base portion 3*a*, i.e. when the leg rest swivel frame 5 is in the default fixed swivel position.

The release member 7 comprises an elongate structure 7*d* extending through the through-opening 5*c*. In the example illustrated in FIG. 2, the elongate structure 7*d* is a pin. The elongate structure 7*d* is fixedly connected to the lifting handle 7*a*. The elongate structure 7*d* is biased in a direction away from the lifting handle 7*a* towards the opening 3*c*. The elongate structure 7*d* is hence biased to engage with the base portion 3*a* and in particular with the opening 3*c*. The leg rest release mechanism 1 may thus comprise a resilient member 8 configured to bias the elongate structure 7*d* to engage with the opening 3*c* of the base portion 3*a*. The resilient member 8 may for example be a spring. The resilient member 8 may be provided around the elongate structure 7*d* in the interior of the base adjacent portion 5*a*.

By pulling the lifting handle 7*a* towards the hand rest portion 5*b* as illustrated by arrow A, the elongate structure 7*d* slides out from the opening 3*c*. The leg rest swivel frame 5 is thereby released from its interlocking with the base member 3.

The elongate structure 7*d* may be provided with a blocking portion 7*f* configured to prevent the release member 7 from being fully pulled out from the leg rest swivel frame 5. In the example shown in FIG. 2, the elongate structure 7*d* has a distal end portion 7*g*. The distal end portion 7*d* is configured to be received by the opening 3*c* of the base portion 3*a* when the release member 7 is engaged with the base portion 3*a*. In the present example, the blocking portion 7*f* is a shoulder located proximally relative to the distal end portion 7*f*. The shoulder is dimensioned to prevent the elongate structure 7*d* from being fully pulled out from the leg rest swivel frame 5. In the example in FIG. 2, the resilient member 8 rests on the shoulder.

Figure 3:
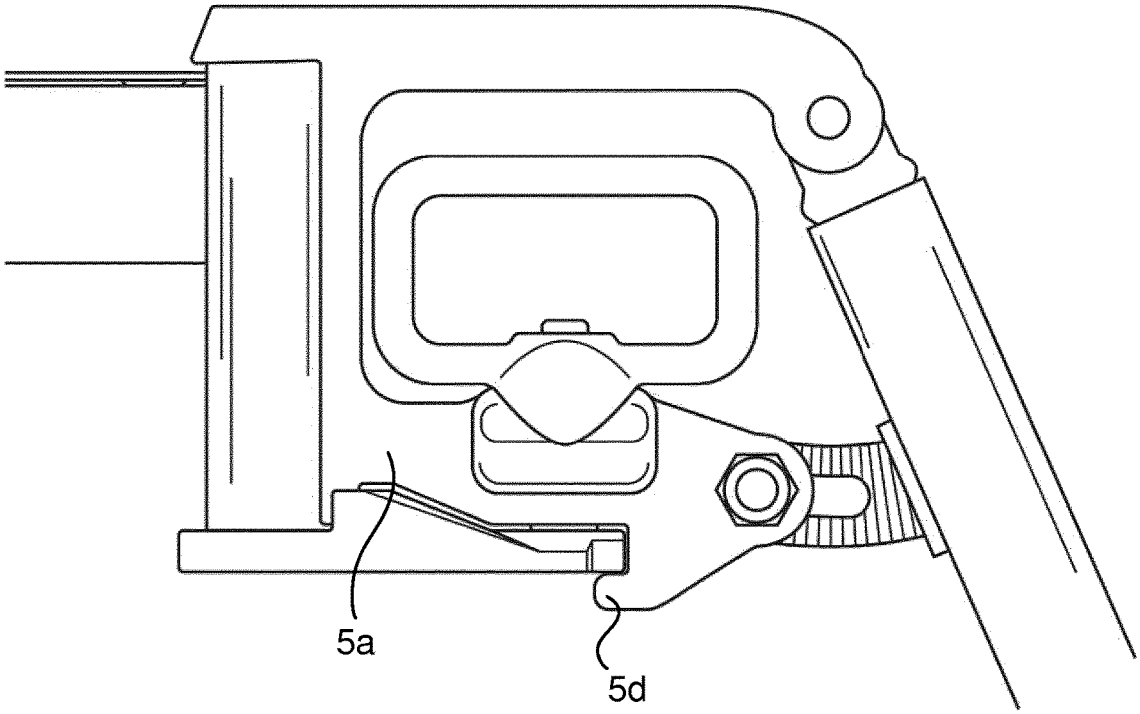
FIG. 3 shows a side view of a lower portion of the leg rest release mechanism in FIG. 1.

The leg rest swivel member 5 may have a latch 5*d* which extends beyond the base portion 3*a* in an axial direction of the axle portion 3*b*, as also shown in FIG. 3. The base portion 3*a* is configured to be received between the latch 5*d* and a main body, in particular the base adjacent portion 5*a*, of the leg rest swivel frame 5. The latch 5*d* thereby prevents axial displacement of the leg rest swivel frame 5 relative to the base member 3 when the leg rest swivel frame 5 is in the default fixed swivel position, and for a limited range of swivel angles of the leg rest swivel frame 5 relative to the axle portion 3*b*. If the release member 7 has been disengaged from the base portion 3*a* and the leg rest swivel frame 5 has been rotated to an angle outside the range of swivel angles relative to the base portion 3*a*, as shown in FIG. 1, the leg rest swivel frame 5 may be lifted from the axle portion 3*b* and removed from the axle portion 3*b*. The swivel connection between the leg rest swivel frame 5 and the axle portion 3*b* may hence be releasable.

The range of swivel angles depends on the structure, e.g. the width, of the base portion 3*a* and on the structure of the base adjacent portion 5*a*. In the example shown in FIGS. 1 and 2, the range of swivel angles may for example be ±25 degrees with respect to an axis defined by the base portion 3*a*, such as ±20 degrees, for example ±18 degrees. The range of swivel angles is preferably kept as small as possible, without compromising the strength of the base portion 3*a* or the base adjacent portion 5*a*, in order to enable the leg rest assembly to be removed with less effort from the user.

Figure 4A:
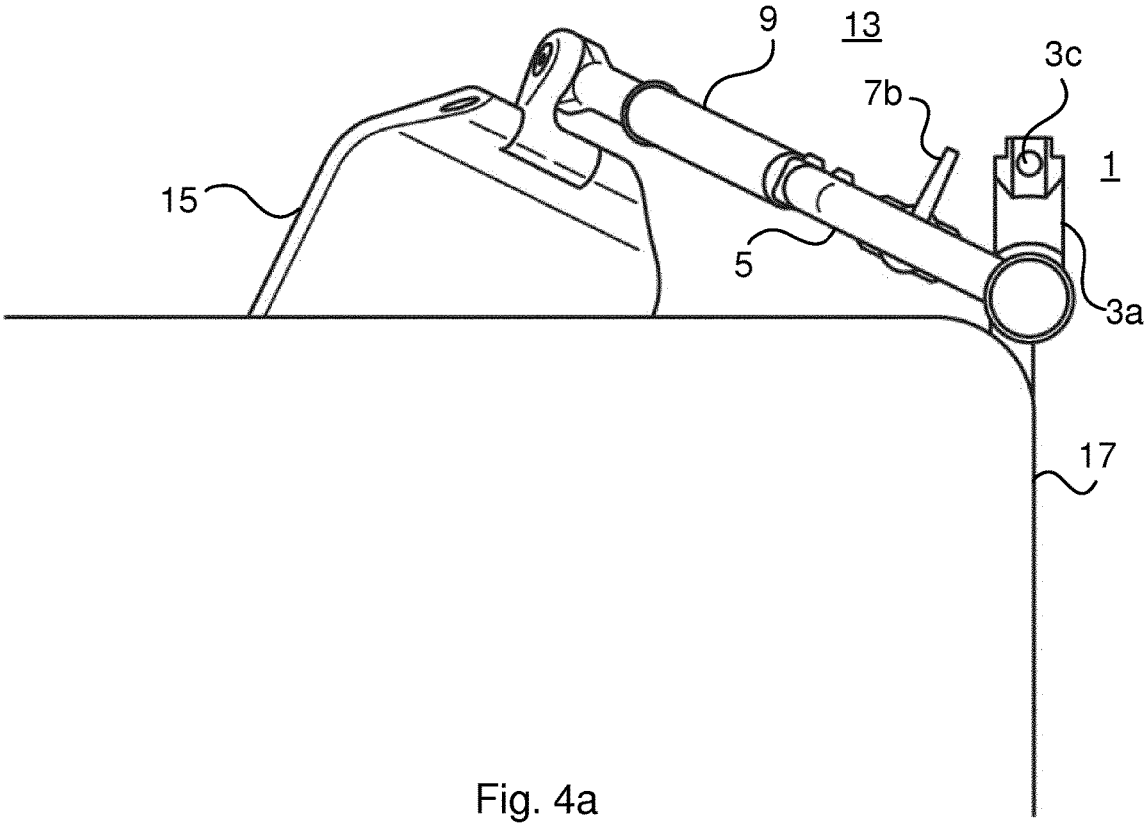
FIGS. 4*a* and 4*b* show top views of two different swivel angles of the leg rest release mechanism in FIG. 1.

FIG. 4*a* shows a top view of a leg rest assembly 13 including the leg rest release mechanism 1, the foot rest mounting member 9 mounted to the leg rest swivel frame 5 and a foot rest 15 mounted to the foot rest mounting member 9. The leg rest assembly 13 is mounted to a front edge of a seat frame 17 of a wheelchair. In particular, the axle portion 3*b* of the leg rest release mechanism 1 may be mounted to the seat frame 17.

In FIG. 4*a*, the leg rest assembly 13 is shown in a position in which the leg rest release frame 5 has been rotated inwards with respect to the seat frame 17 to reduce the width of the wheelchair. This may be advantageous when the wheelchair is to be stowed away. The leg rest assembly 13 may also be removed to further reduce the footprint of the wheelchair.

Figure 4B:
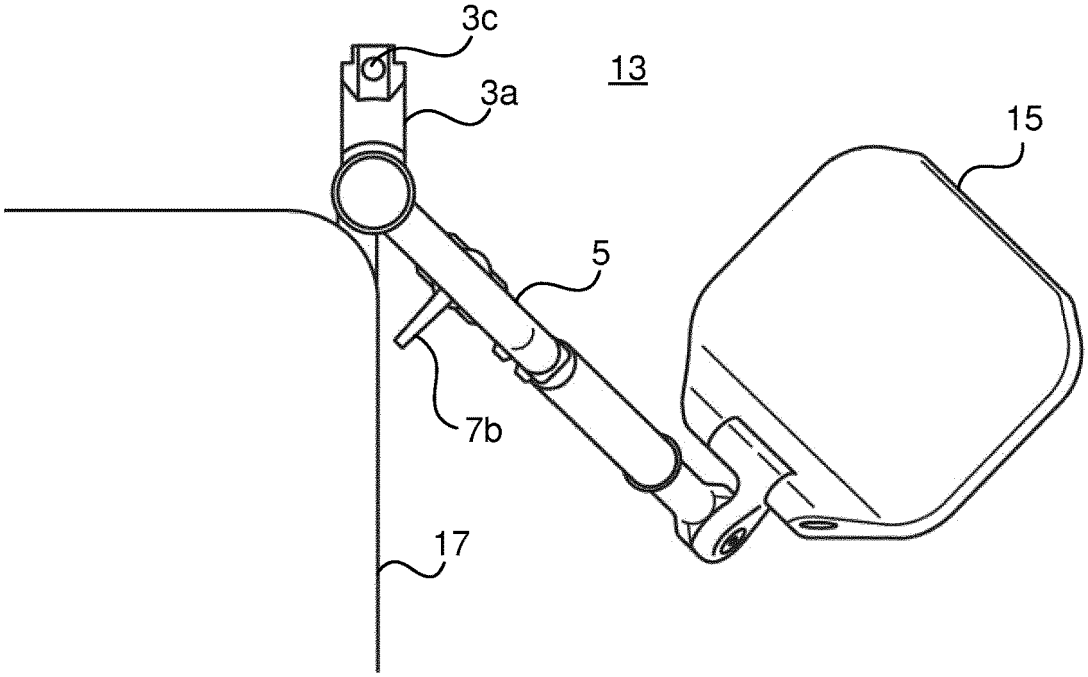

In FIG. 4*b* the leg rest assembly 13 is shown in a position in which the leg rest release frame 5 has been rotated laterally outwards with respect to the seat frame 17. This facilitates for the user to move in to or move out of the wheelchair, since the leg rest assembly 13 has been moved to the side.

Figure 5:
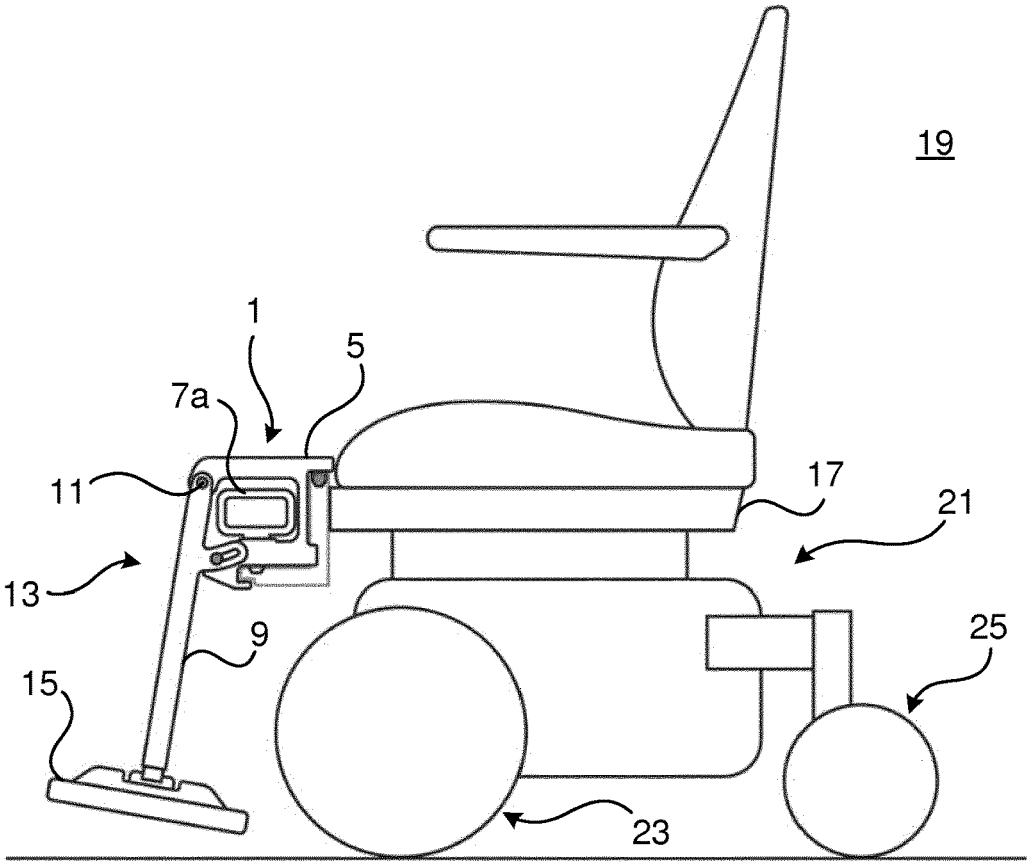
FIG. 5 schematically shows a side view of a wheelchair comprising the leg rest release mechanism in FIG. 1.

FIG. 5 shows an example of a wheelchair 19 comprising the seat frame 17. The depicted wheelchair 19 comprises the leg rest assembly 13, i.e. the leg rest release mechanism 1, the foot rest mounting member 9 and the foot rest 15, mounted to the seat frame 17. The wheelchair 19 may comprise two leg rest assemblies 13, one at each front edge of the seat frame 17, for each leg of a user.

The exemplified wheelchair 19 is a powered wheelchair, but could alternatively be a manual wheelchair. The wheelchair 19 comprises a chassis 21, drive wheels 23, and caster wheels 25.

The powered wheelchair 19 is a front wheel drive type wheelchair, but could alternatively be any of a midwheel drive type wheelchair, rear wheel drive type, or any other type of drive configuration.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A leg rest release mechanism for a wheelchair, wherein the leg rest release mechanism comprises:

a base member having a base portion and an elongated axle portion extending from the base portion, a leg rest swivel frame in swivel connection with the axle portion to enable swivelling of the leg rest swivel frame relative to the axle portion, wherein the leg rest swivel frame is configured to be connected to an elongated foot rest mounting member provided with a foot rest, and a release member having a lifting handle, wherein:

the release member extends through the leg rest swivel frame, the release member is biased to engage with the base portion to thereby lock the leg rest swivel frame in a fixed position relative to the base member, the release member is configured to disengage from the base portion by pulling of the lifting handle, whereby the leg rest swivel frame is enabled to swivel relative to the base member, the release member is rotatable relative to the base portion and the leg rest swivel frame, the release member includes a rotation handle fixed relative to the lifting handle for rotating the release member, and rotation of the release member from a default position in which the release member engages with the base portion causes the release member to be axially displaced relative to the base portion, thereby disengaging from the base portion.

2. The leg rest release mechanism as claimed in claim 1, wherein the release member and the leg rest swivel frame are structured so that rotation of the release member from the default position causes the axial displacement.

3. The leg rest release mechanism as claimed in claim 1, wherein the rotation handle is at a right angle with the lifting handle.

4. The leg rest release mechanism as claimed in claim 1, wherein the leg rest swivel frame has a base adjacent portion through which the release member extends, and a hand rest portion spaced apart from the base adjacent portion and aligned with the lifting handle, wherein the lifting handle is configured to be pulled towards the hand rest portion to disengage the release member from the base portion.

5. The leg rest release mechanism as claimed in claim 1, wherein the base portion includes an opening and the release member has an elongate structure fixed to the lifting handle, which elongate structure is configured to extend through the leg rest swivel frame, wherein the elongate structure is biased towards and configured to be received by the opening to provide the engagement between the base portion and the release member.

6. The leg rest release mechanism as claimed in claim 5, wherein the elongate structure is a pin.

7. The leg rest release mechanism as claimed in claim 1, wherein the leg rest swivel frame has a latch configured to restrict axial displacement of the leg rest swivel frame relative to the base member only for a range of swivel angles of the leg rest swivel frame relative to the axle portion.

8. The leg rest release mechanism as claimed in claim 7, wherein the latch extends axially, with respect to an axis defined by the axle portion, beyond the base portion, the base portion being arranged between the latch and a main body of the leg rest swivel frame only for the range of swivel angles.

9. The leg rest release mechanism as claimed in claim 1, wherein the release member has a blocking portion configured to prevent the release member from being fully pulled out from the leg rest swivel frame.

10. A leg rest assembly comprising:

a leg rest release mechanism comprising:

a base member having a base portion and an elongated axle portion extending from the base portion, a leg rest swivel frame in swivel connection with the axle portion to enable swivelling of the leg rest swivel frame relative to the axle portion, and a release member having a lifting handle, wherein:

the release member extends through the leg rest swivel frame, the release member is biased to engage with the base portion to thereby lock the leg rest swivel frame in a fixed position relative to the base member, the release member is configured to disengage from the base portion by pulling of the lifting handle, whereby the leg rest swivel frame is enabled to swivel relative to the base member the release member is rotatable relative to the base portion and the leg rest swivel frame, the release member includes a rotation handle fixed relative to the lifting handle for rotating the release member, and rotation of the release member from a default position in which the release member engages with the base portion causes the release member to be axially displaced relative to the base portion, thereby disengaging from the base portion, a foot rest mounting member connected to the leg rest swivel frame, and a foot rest mounted to the foot rest mounting member.

11. A wheelchair comprising:

a leg rest release mechanism comprising:

a base member having a base portion and an elongated axle portion extending from the base portion, a leg rest swivel frame in swivel connection with the axle portion to enable swivelling of the leg rest swivel frame relative to the axle portion, and a release member having a lifting handle, wherein:

the release member extends through the leg rest swivel frame, the release member is biased to engage with the base portion to thereby lock the leg rest swivel frame in a fixed position relative to the base member, the release member is configured to disengage from the base portion by pulling of the lifting handle, whereby the leg rest swivel frame is enabled to swivel relative to the base member the release member is rotatable relative to the base portion and the leg rest swivel frame, the release member includes a rotation handle fixed relative to the lifting handle for rotating the release member, and rotation of the release member from a default position in which the release member engages with the base portion causes the release member to be axially displaced relative to the base portion, thereby disengaging from the base portion.

12. The wheelchair as claimed in claim 11, comprising a seat frame, wherein the axle portion is attached to a front edge of the seat frame.

13. The wheelchair as claimed in claim 11, comprising an elongated foot rest mounting member connected to the leg rest swivel frame, and a foot rest mounted to the foot rest mounting member.

14. The wheelchair as claimed in claim 13, wherein the foot rest mounting member is pivotally connected to the leg rest swivel frame to enable changing of the position of the foot rest.

15. A leg rest release mechanism for a wheelchair, wherein the leg rest release mechanism comprises:

a base member having a base portion and an elongated axle portion extending from the base portion, a leg rest swivel frame in swivel connection with the axle portion to enable swivelling of the leg rest swivel frame relative to the axle portion, wherein the leg rest swivel frame is configured to be connected to an elongated foot rest mounting member provided with a foot rest, and a release member having a lifting handle, wherein:

the release member extends through the leg rest swivel frame, the release member is biased to engage with the base portion to thereby lock the leg rest swivel frame in a fixed position relative to the base member, the release member is configured to disengage from the base portion by pulling of the lifting handle, whereby the leg rest swivel frame is enabled to swivel relative to the base member, the leg rest swivel frame has a base adjacent portion through which the release member extends, and a hand rest portion spaced apart from the base adjacent portion and aligned with the lifting handle, and the lifting handle is configured to be pulled towards the hand rest portion to disengage the release member from the base portion.

16. A leg rest release mechanism for a wheelchair, wherein the leg rest release mechanism comprises:

a base member having a base portion and an elongated axle portion extending from the base portion, a leg rest swivel frame in swivel connection with the axle portion to enable swivelling of the leg rest swivel frame relative to the axle portion, wherein the leg rest swivel frame is configured to be connected to an elongated foot rest mounting member provided with a foot rest, and a release member having a lifting handle, wherein:

the release member extends through the leg rest swivel frame, the release member is biased to engage with the base portion to thereby lock the leg rest swivel frame in a fixed position relative to the base member, the release member is configured to disengage from the base portion by pulling of the lifting handle, whereby the leg rest swivel frame is enabled to swivel relative to the base member, and the leg rest swivel frame has a latch configured to restrict axial displacement of the leg rest swivel frame relative to the base member only for a range of swivel angles of the leg rest swivel frame relative to the axle portion.

17. The leg rest release mechanism as claimed in claim 16, wherein the latch extends axially, with respect to an axis defined by the axle portion, beyond the base portion, the base portion being arranged between the latch and a main body of the leg rest swivel frame only for the range of swivel angles.

* * * * *